US005466137A

United States Patent [19]

Bierlein et al.

[11] Patent Number: 5,466,137

[45] Date of Patent: Nov. 14, 1995

[54] ROLLER GEROTOR DEVICE AND PRESSURE BALANCING ARRANGEMENT THEREFOR

[75] Inventors: John C. Bierlein, Shelby Township, Mich.; Wayne B. Wenker, Minnetonka; Jerry L. Yoho, Eden Prairie, both of Minn.

[73] Assignee: Eaton Corporation, Cleveland, Ohio

[21] Appl. No.: 306,802

[22] Filed: Sep. 15, 1994

[51] Int. Cl.[6] ..... F01C 1/113; F01C 21/00

[52] U.S. Cl. ..... 418/75; 418/79; 418/80; 418/81; 418/132; 418/171

[58] Field of Search ..... 418/75, 79, 80, 418/81, 132, 166, 170, 171

[56] References Cited

U.S. PATENT DOCUMENTS

| | | | |
|---|---|---|---|
| 3,303,793 | 2/1967 | Morita | 418/166 |
| 3,623,929 | 11/1971 | Shaw et al. | 418/171 |
| 3,869,228 | 3/1975 | Swedberg | 418/132 |
| 4,411,607 | 10/1983 | Wusthof et al. | 418/61.3 |
| 5,104,303 | 4/1992 | Mori et al. | 418/75 |
| 5,354,188 | 10/1994 | Arbogast et al. | 418/171 |

FOREIGN PATENT DOCUMENTS

| | | | |
|---|---|---|---|
| 63-131877 | 6/1988 | Japan | 418/171 |
| 1255751 | 9/1986 | U.S.S.R. | 418/75 |

*Primary Examiner*—John J. Vrablik
*Attorney, Agent, or Firm*—L. J. Kasper

[57] ABSTRACT

A roller gerotor device is disclosed including an outer rotor (39) and an inner rotor (31), and a plurality of rollers (37) serving as teeth. The device includes a housing means (11,45,47) defining a first wear surface (67) disposed axially adjacent first axial end surfaces (55,63) of the rotors. The first wear surface cooperates with one of the rotors to define an annular fluid passage (83) and a plurality of fluid grooves communicating with the passage (83) and extending radially outward. At least a terminal portion of each of the grooves (87) is adjacent an axial end surface (59) of each roller member (37) as the rotors rotate. Each of the terminal portions (95) becomes progressively shallower in the direction of rotation of the rotors, thus building up fluid pressure in the fluid groove (87) to prevent gouging or galling of the roller end surface against the adjacent wear surface (67).

13 Claims, 7 Drawing Sheets

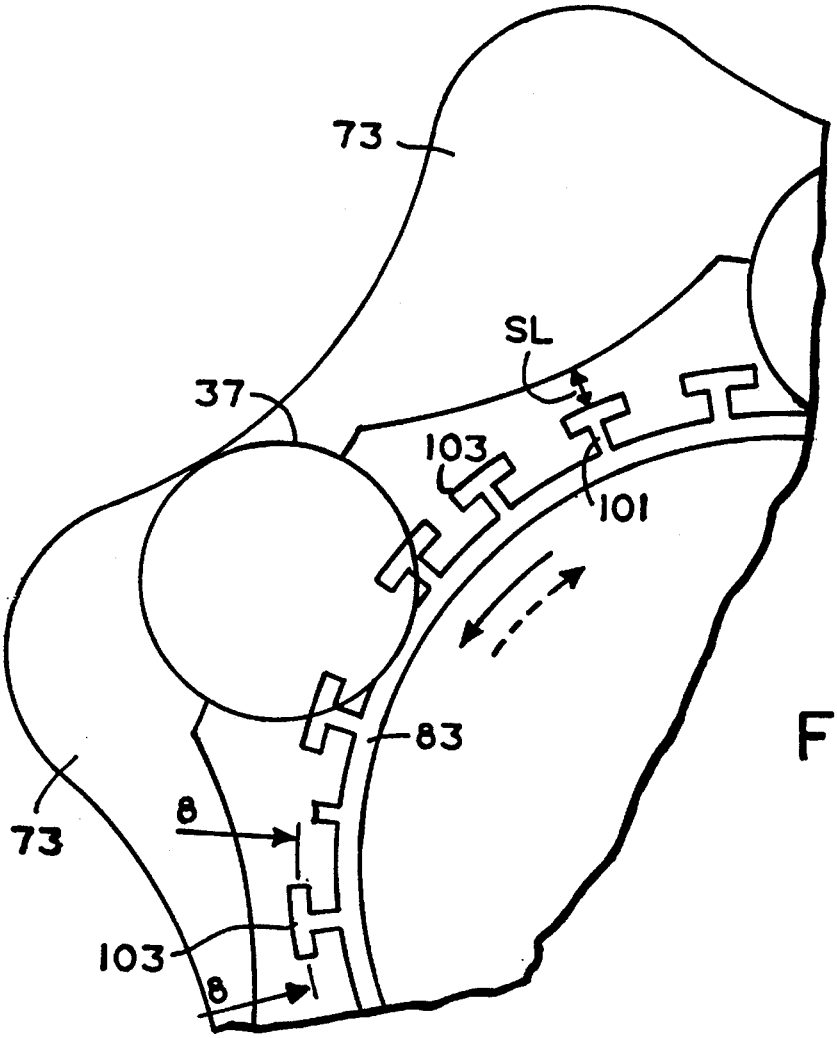
FIG. 7
FIG. 8
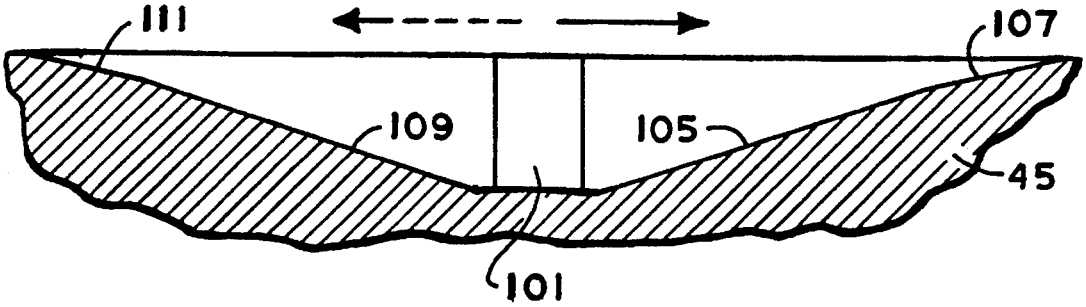

FIG. 9
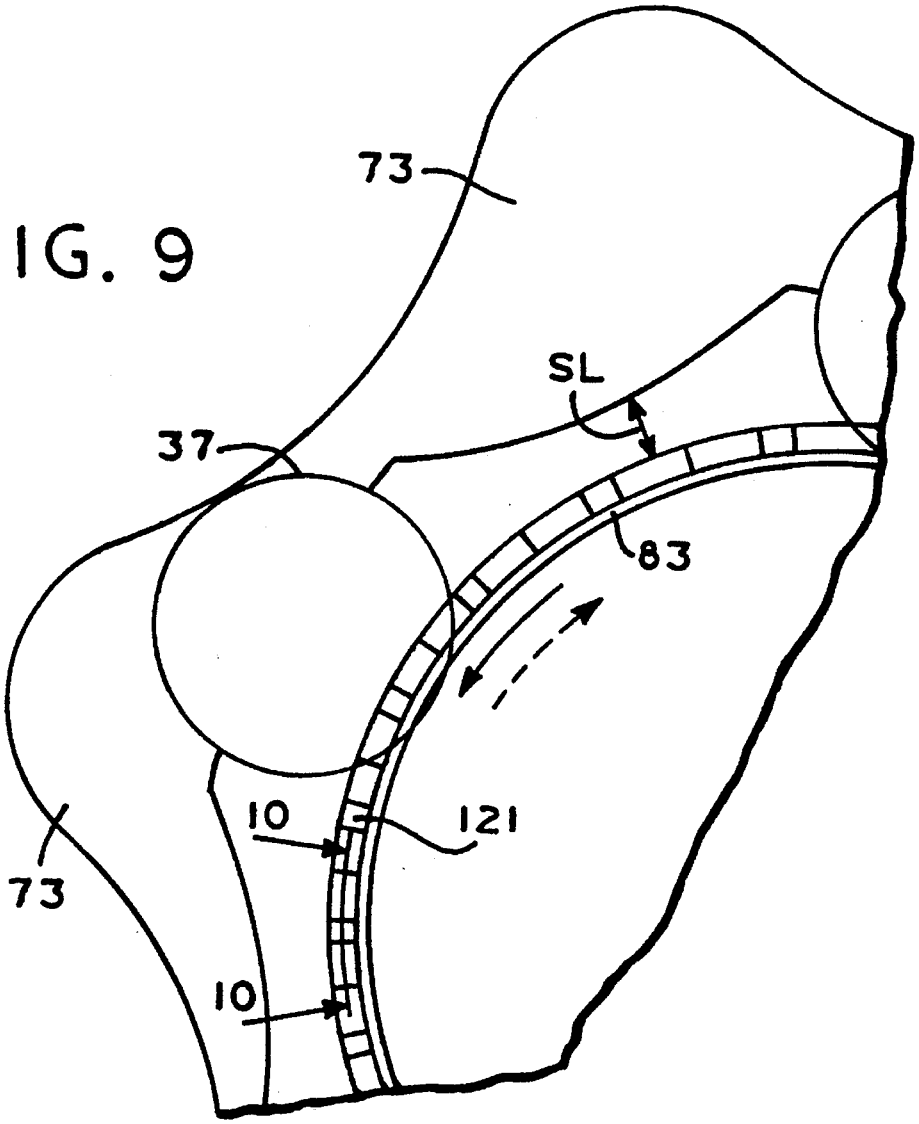
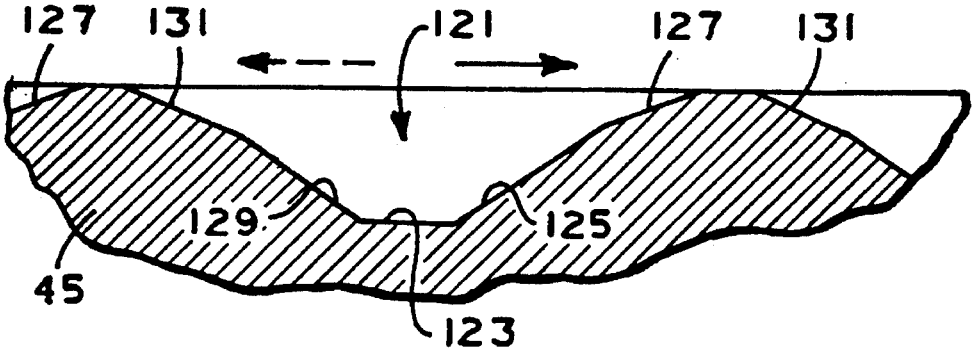
FIG. 10

ROLLER GEROTOR DEVICE AND PRESSURE BALANCING ARRANGEMENT THEREFOR

BACKGROUND OF THE DISCLOSURE

The present invention relates to hydraulic devices such as pumps and motors, and more particularly to such devices in which the fluid displacement mechanism is of the roller gerotor type. Hydraulic devices including displacement mechanisms of the roller gerotor type are sold commercially by the assignee of the present invention under the trademark Geroler®, which trademark is owned by the assignee of the present invention.

Although the present invention may be utilized with any type of hydraulic device having a fluid displacement mechanism of the roller gerotor type, it is especially suited for use with gerotors of the internally-generated rotor (IGR) type, and will be described in connection therewith.

A fluid displacement mechanism of the IGR type is illustrated and described in U.S. Pat. No. 3,623,829, incorporated herein by reference. In an IGR device, there is an inner gear (or inner rotor) defining a plurality N of cylindrical openings, each of which has a cylindrical roller disposed therein. The cylindrical rollers serve as the external teeth of the inner gear. The inner gear is eccentrically disposed within a conjugate, internally-toothed outer gear (or outer rotor) having a plurality N+1 of internal teeth.

An IGR device is especially suited for use in a pump, in which case both the inner gear and the outer gear rotate about their respective axes of rotation. When an IGR device is utilized in a pump, there is no relative orbital rotation between the axes of the gears, as is normally the case in an orbiting gerotor of the type used in a low speed, high torque motor. The primary advantage of an IGR device, when used in a pump, is that centrifugal force on the rollers (the external teeth of the inner gear) causes the roller to seal against the conjugate surface (internal teeth) of the outer gear, thus providing for improved volumetric efficiency.

Despite the advantages noted above, IGR type pumping devices have not been especially successful, commercially. There are two basic design approaches available with IGR pumps. In one design approach, which is referred to as a "fixed clearance" design, the housing members immediately axially adjacent the end surfaces of the gerotor are maintained at a fixed axial separation, thus making it nearly certain that there will be a slight clearance between the end surfaces of the gerotor and the adjacent housing surfaces. Such a clearance inherently limits the performance of the pump. If relatively high volumetric efficiency is desired, the rated pressure of the pump must be relatively lower. Conversely, if it desired to have a relatively higher rated pressure for the pump, the volumetric efficiency will be lower.

The other design approach is to have axially movable balancing members adjacent the axial end surfaces of the gerotor, with the balancing members biased into sealing engagement with the end surfaces of the gerotor, for example, by means of fluid pressure. Typically, in such a design, the balancing is accomplished using the output pressure of the pump. The use of this design approach substantially eliminates the clearances along the axial end faces of the gerotor, thus making it possible to operate the pump at a relatively high rated pressure, while still maintaining relatively high volumetric efficiency.

However, in spite of the theoretical advantages of an IGR pump with pressure biased sealing members, there has apparently not been a commercially successful pump of this design. In connection with the development of the present invention, several possible reasons for such lack of commercial success appeared. The pressure biasing or clamping of the members adjacent the IGR type gerotor results in high speed relative rubbing movement between the gerotor (which is rotating) and the adjacent sealing members (which are stationary). It has been observed that such high speed relative motion results in galling between the ends faces of the outer gear and the adjacent surface of the sealing member. As is well known to those skilled in the art, galling typically occurs when there is a breakdown of, or a total loss of, the fluid film between two relatively rotating, engaged metal surfaces. As is also well known to those skilled in the art, galling between two adjacent, engaged metal surfaces typically leads to destruction or inoperability of the device within a fairly short time.

It was also observed in connection with the development of the present invention that the end surfaces of the rollers would gouge the adjacent surface of the sealing member, sometimes in addition to causing galling, either of which, individually, would also lead to destruction or inoperability of the device in a fairly short time. It has been hypothesized that one cause of the gouging of the adjacent surface was lack of perfect perpendicularity between the end surface of the roller and the axes of the roller, such that the end surface of the roller is not perfectly parallel to the adjacent sealing surface, but instead, a portion of the end surface of the roller gouges or digs into the adjacent sealing surface.

It has been known by those skilled in the art to place a break or chamfer on the corners of the rolls, and even to crown the end surfaces of the rolls, in an attempt to have pressurized fluid acting on the axially opposite ends of the rolls. However, any such attempt at balancing the rolls which involves communicating pressurized fluid from the adjacent volume chambers is, in effect, a leak path which results in a loss of volumetric efficiency.

SUMMARY OF THE INVENTION

Accordingly, it is an object of the present invention to provide an improved hydraulic device of the type including a fluid displacement mechanism which makes it possible to eliminate the shortcomings of the "fixed clearance" design, while at the same time, avoiding the problems of galling and gouging described above, without decreasing the volumetric efficiency of the device.

It is a more specific object of the present invention to provide an improved hydraulic device, including a fluid displacement mechanism of the IGR type, in which adjacent sealing members are biased into engagement with the IGR type gerotor but wherein means are provided for preventing metal-to-metal engagement between the end surfaces of the gears and rollers and the adjacent sealing surface.

The above and other objects of the invention are accomplished by the provision of a rotary fluid displacement mechanism of the type comprising housing means defining a fluid inlet port and a fluid outlet port, and having a gear set operably associated with the housing means and including a first rotor and a second rotor. Each of the first and second rotors defines teeth, whereby rotation of the first and second rotors defines an expanding volume chamber in fluid communication with the fluid inlet port, and a contracting volume chamber in fluid communication with the fluid outlet port. The housing means defines a first wear surface disposed axially adjacent first axial end surfaces of the first and second rotors, and in sealing engagement therewith.

The improved rotary fluid displacement mechanism is characterized by the first wear surface cooperating with the first and second rotors to define a first generally annular fluid passage in fluid communication with either the fluid inlet port or the fluid outlet port. The first wear surface further defines a first plurality of fluid grooves, each of the fluid grooves being in fluid communication with the first annular fluid passage, and, in a preferred embodiment, extending radially therefrom. At least a terminal portion of each of the fluid grooves is disposed to be adjacent a first axial end surface of one of the first and second rotors, as the rotors rotate. Each of the terminal portions of the fluid grooves becomes progressively shallower in the direction of the rotation of the rotors.

BRIEF DESCRIPTION OF THE DRAWINGS

FIG. 7 is a fragmentary, somewhat schematic, overlay view, similar to FIG. 5, illustrating an alternative embodiment of the present invention.

FIG. 8 is an enlarged, fragmentary, transverse cross-section taken on line 8—8 of FIG. 7.

FIG. 9 is a fragmentary, somewhat schematic, overlay view, similar to FIG. 7, illustrating another alternative embodiment of the present invention.

FIG. 10 is an enlarged, fragmentary, transverse cross-section taken on line 10—10 of FIG. 9.

DESCRIPTION OF THE PREFERRED EMBODIMENT

Figure 1:
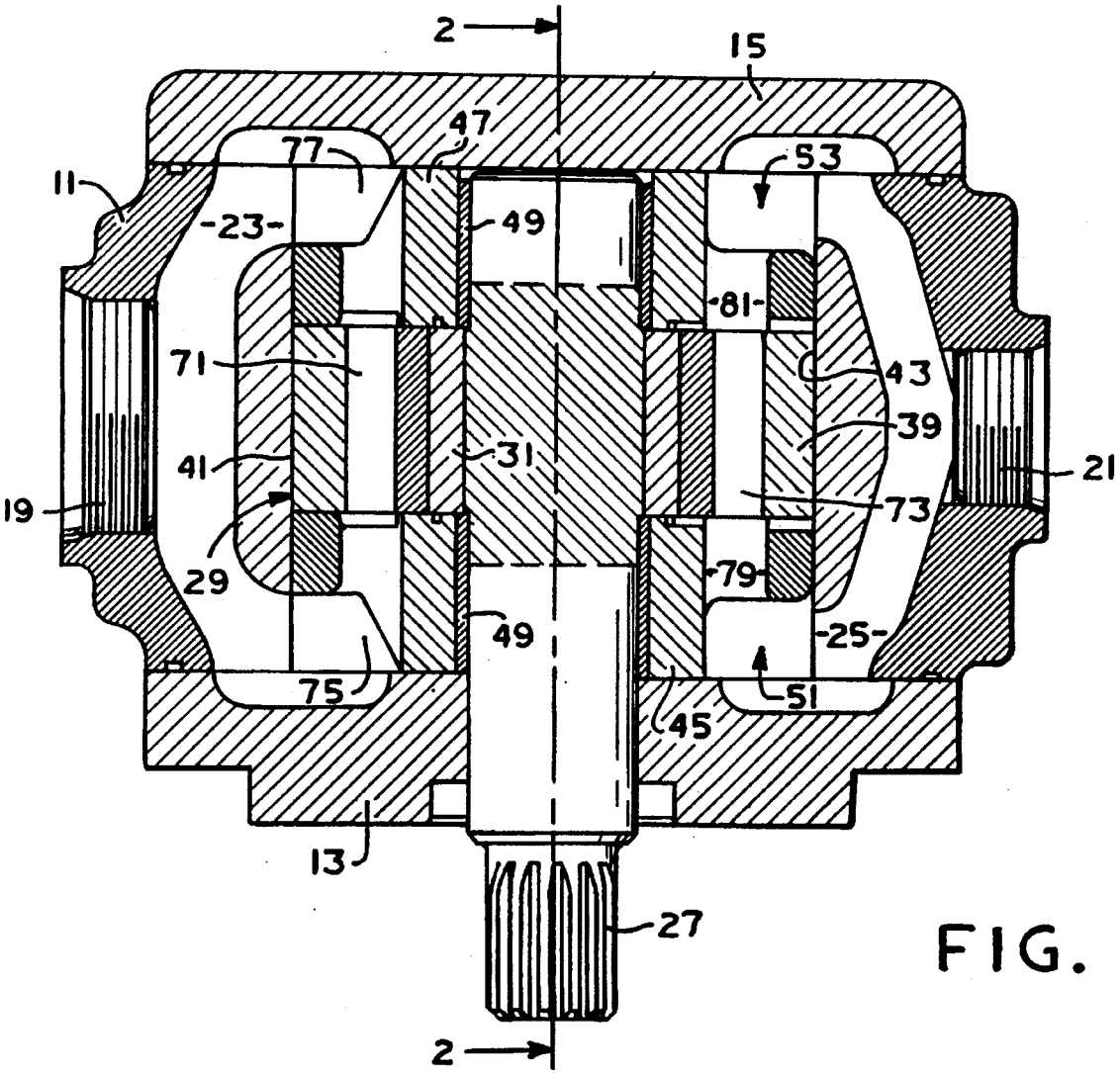
FIG. 1 is a horizontal cross-section of an hydraulic pump including a fluid displacement mechanism of the IGR type.
Figure 2:
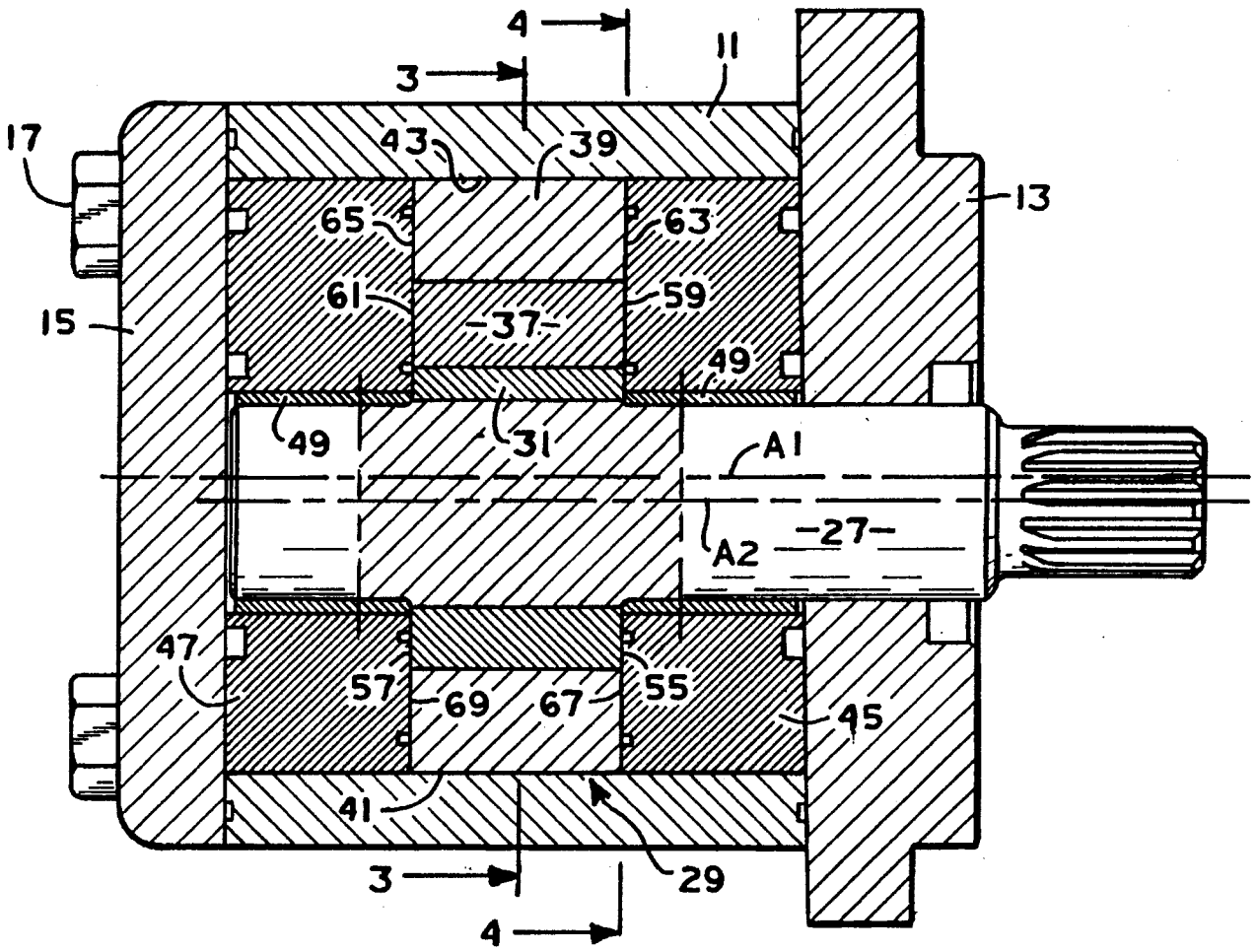
FIG. 2 is a vertical, axial cross-section, taken on line 2—2 of FIG. 1, and on the same scale.

Referring now to the drawings, which are not intended to limit the invention, FIGS. 1 and 2 show axial cross section views of an hydraulic pump of the type with which the present invention may be utilized. The pump may be constructed generally in accordance with the teachings of above-incorporated U.S. Pat. No. 3,623,829. It will be understood by those skilled in the art that, except as specifically noted hereinafter, the overall configuration, as well as many of the construction details of the pump are not essential features of the invention.

The pump comprises a housing member 11 which cooperates with a front end cap 13 and a rear end cap 15 to define therein an enclosed pumping cavity. The housing member 11 and the end caps 13 and 15 are held together in tight sealing engagement by means of a plurality of bolts 17 (not shown in FIG. 1). The housing member 11 defines a fluid inlet port 19 and a fluid outlet port 21 (not shown in FIG. 2). The inlet port 19 opens into an inlet chamber 23, while the outlet port 21 is in open communication with an outlet chamber 25.

Figure 3:
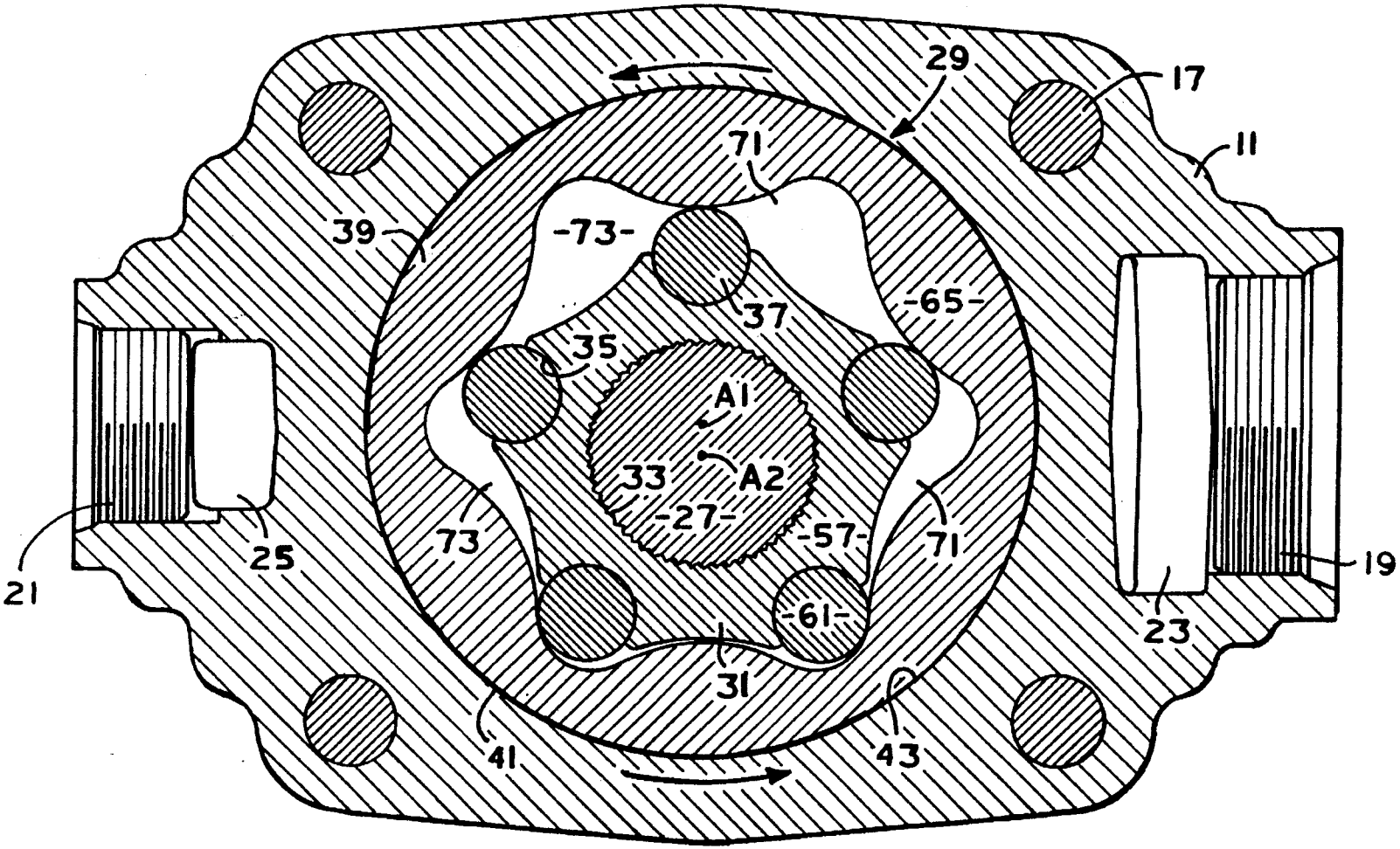
FIG. 3 is a transverse cross-section, taken on line 3—3 of FIG. 2, and on a somewhat larger scale, illustrating the IGR displacement mechanism.

Referring now to FIG. 3, in conjunction with FIGS. 1 and 2, an input shaft 27 extends through an opening in the front end cap 13, and extends axially almost to the rear end cap 15. The input shaft 27 extends through, and is in driving engagement with a pumping element or fluid displacement mechanism, generally designated 29. In the subject embodiment, the displacement mechanism 29 comprises a gerotor of the internally generated rotor (IGR) type. The IGR device includes an inner rotor 31, which defines, about its inside diameter, a plurality of serrations 33, by means of which the inner rotor 31 is in driven engagement with the input shaft 27. The inner rotor defines five generally semi-cylindrical openings 35, and within each of which there is disposed a cylindrical roller member 37. The inner rotor 31 is eccentrically disposed within an outer rotor 39 which defines a cylindrical outer surface 41, which is received and journalled within a cylindrical opening 43 defined by the housing member 11.

Referring now primarily to FIGS. 2 and 3, the outer rotor 39 defines an axis of rotation A1 about which it rotates, and at the same time, the inner rotor 31 defines an axis of rotation A2, about which it rotates. However, in the subject embodiment, the pumping element 29 is of the "fixed axis" type, i.e., both of the axes of rotation A1 and A2 remain fixed or stationary, and neither axis orbits about the other axis, as occurs in orbiting gerotor type devices.

As may best be seen in FIGS. 1 and 2, the cylindrical opening 43 extends substantially the entire axial length of the housing member 11. Disposed within the opening 43 and journalled therein, is a forward bushing block 45 (also referred to hereinafter as a sealing member). The forward bushing block 45 is disposed axially between the pumping element 29 and the front end cap 13. Also disposed within, and journalled by the opening 43 is a rearward bushing block 47 (shown only in FIGS. 1 and 2). Each of the bushing blocks 45 and 47 may have a cylindrical bushing member 49 disposed within the ID of the bushing block, for receiving and rotatably supporting the input shaft 27.

As may best be seen in FIG. 1, the bushing block 45 defines a cutout portion 51, and the rear bushing block 47 defines a cutout portion 53, both of the cutout portions 51 and 53 being in open fluid communication with the outlet chamber 25. Thus, in the subject embodiment, with the inlet port 19 receiving low pressure fluid, and with high pressure fluid being pumped out of the outlet port 21, high (system) pressure acts on the back surface (i.e., the surface opposite the pumping element 29) of each of the bushing blocks 45 and 47. As is well known to those skilled in the art, the result of the high pressure on the blocks 45 and 47 is to bias them axially toward the rotors 31 and 39, into relatively tight, sealing engagement therewith. As was described in the background of the disclosure, the typical result of such biasing or clamping of the bushing blocks into engagement with the rotors is to increase substantially the rated pressure of the pump as well as its volumetric efficiency, while at the same time, substantially increasing the risk of galling between adjacent, relatively rotating surfaces, and gouging by the end surfaces of the roller members 37.

Referring again primarily to FIG. 3, in conjunction primarily with FIG. 2, the inner rotor 31 defines a forward end surface 55 (seen only in FIG. 2) and a rearward end surface 57. Similarly, each of the roller members 37 defines a forward end surface 59 and a rearward end surface 61. Finally, the outer rotor 39 defines a forward end surface 63 and a rearward end surface 65. The forward bushing block 45 defines a wear surface or sealing surface 67, disposed in sealing engagement with the forward end surfaces 55, 59, and 63. Similarly, the rearward bushing block 47 defines a wear surface or sealing surface 69, which is in sealing engagement with the rearward end surfaces 57, 61, and 65.

Figure 4:
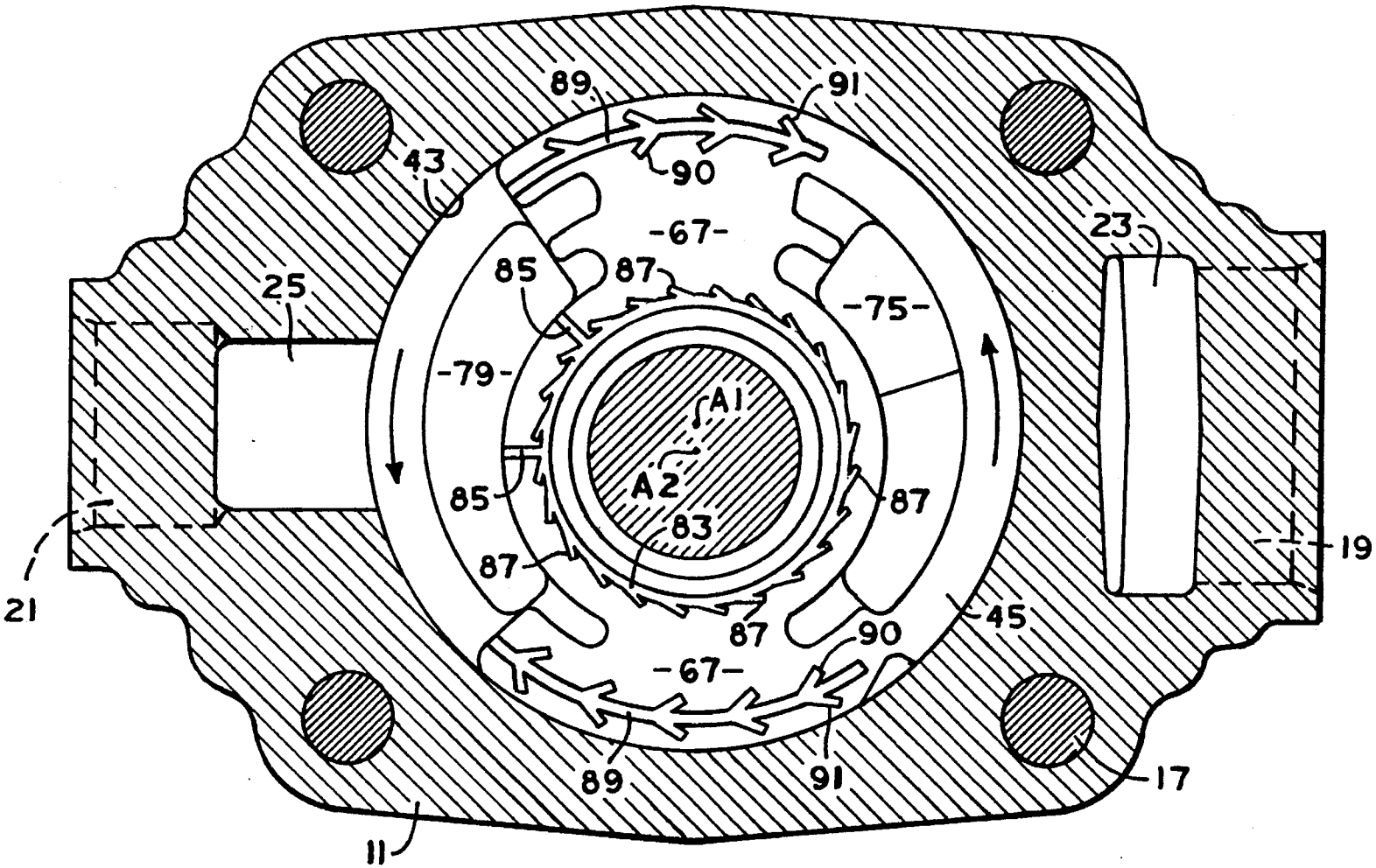
FIG. 4 is a transverse cross-section, taken on line 4—4 of FIG. 2, and on the same scale as FIG. 3, illustrating the sealing member of the pump made in accordance with the present invention.

Referring primarily to FIGS. 1, 3 and 4, as the input shaft 27 rotates counter-clockwise (see arrows in FIG. 3), the inner and outer rotors 31 and 39 also rotate counter clockwise, and the toothed interaction therebetween defines an expanding volume chamber 71 and a contracting volume chamber 73. The forward bushing block 45 defines an inlet kidney 75 receiving inlet fluid through the inlet chamber 23. Similarly, the rearward bushing block 47 defines an inlet kidney 77 (shown only in FIG. 1) receiving inlet fluid from the inlet chamber 23. The forward bushing block 45 also defines an outlet kidney 79 through which high pressure fluid is pumped into the outlet chamber 25. Similarly, the rearward bushing block 47 defines an outlet kidney 81 through which pressurized fluid is pumped into the outlet chamber 25. The forward and rearward axial ends of the expanding volume chambers 71 receive inlet fluid from the inlet kidneys 75 and 77 respectively, while the forward and rearward axial ends of the contracting volume chambers 73 communicate pressurized fluid into the outlet kidneys 79 and 81, respectively. Those skilled in the art will understand that, preferably, the forward and rearward bushing block 45 and 47 are mirror images of each other (not interchangeable), but are otherwise identical, such that detailed description of either one should provide a complete understanding of the other as well.

Referring now primarily to FIG. 4, the wear surface 67 defines a generally annular fluid passage 83, which is in fluid communication with high pressure in the outlet kidney 79 by means of a pair of radial passages 85. Thus, the annular passage 83 contains substantially pump outlet pressure. It should be apparent to those skilled in the art that the annular passage 83 may be "segmented" into several individual arcuate passages, as long as each individual passage is in fluid communication with whichever of the kidneys contains fluid at the pressure desired to be present in the passage 83. In open communication with the annular passage 83 is a plurality of short fluid grooves 87, each of which extend generally radially outward from the annular passage 83. As used herein, the term "radially outward" will be understood to mean not that the grooves 87 are oriented radially (although a portion thereof could be) but instead, merely means that the grooves 87 extend outward some distance beyond the passage 83, for reasons which will become apparent subsequently. Furthermore, it is a fairly significant aspect of the present invention that each of the fluid grooves 87 are oriented generally in the direction of rotation of the rotors 31 and 39. Therefore, as may best be seen in FIGS. 3 and 4, with the rotors rotating counter-clockwise, each of the fluid grooves 87 extends from the annular passage 83 in a direction which is somewhat radially outward therefrom, and somewhat "forward" in the counter-clockwise direction of rotation.

The wear surface 67 of the forward bushing block 45 also defines a pair of arcuate fluid passages 89, each of which is in open communication with the high pressure contained in the outlet kidney 79. Depending upon the configuration of the bushing block 45, the arcuate fluid passages 89 could comprise a single, annular fluid passage in the same manner as the annular fluid passage 83. A plurality of fluid grooves 90 is in open communication with the arcuate fluid passage 89, and extend generally radially inward from, and forward therefrom, in the counter-clockwise direction, in the same manner and for the same reasons as applied to the fluid grooves 87, and a plurality of fluid grooves 91 is in open communication with the arcuate fluid passage 89, and extend generally radially outward from, and forward therefrom, in the counter-clockwise direction, in the same manner and for the same reasons as applied to the fluid grooves 87. Thus, within the scope of the present invention, the fluid grooves may extend radially inward or outward, depending upon the particular configurational details.

Preferably, the rearward bushing block 47 has substantially identical fluid passages and fluid grooves as those described in connection with the bushing block 45. It is important that, if the rearward bushing block 47 has the same arrangement of fluid passages and grooves as in bushing block 45, the fluid passages and fluid grooves of the two bushing blocks should be in a "mirror" image relative to each other. For example, both ends of a particular roller should just begin to communicate, at the same time, and to the same extent, with the respective fluid grooves 87, in order that the rollers remain axially "balanced", and are not subjected to any unbalanced axial forces. However, such is not an essential feature of the present invention, but if only one of the bushing blocks is provided with the fluid passages and fluid grooves just described, the other bushing block should at least have a suitable bearing material on its wear surface (sealing surface).

Figure 5:
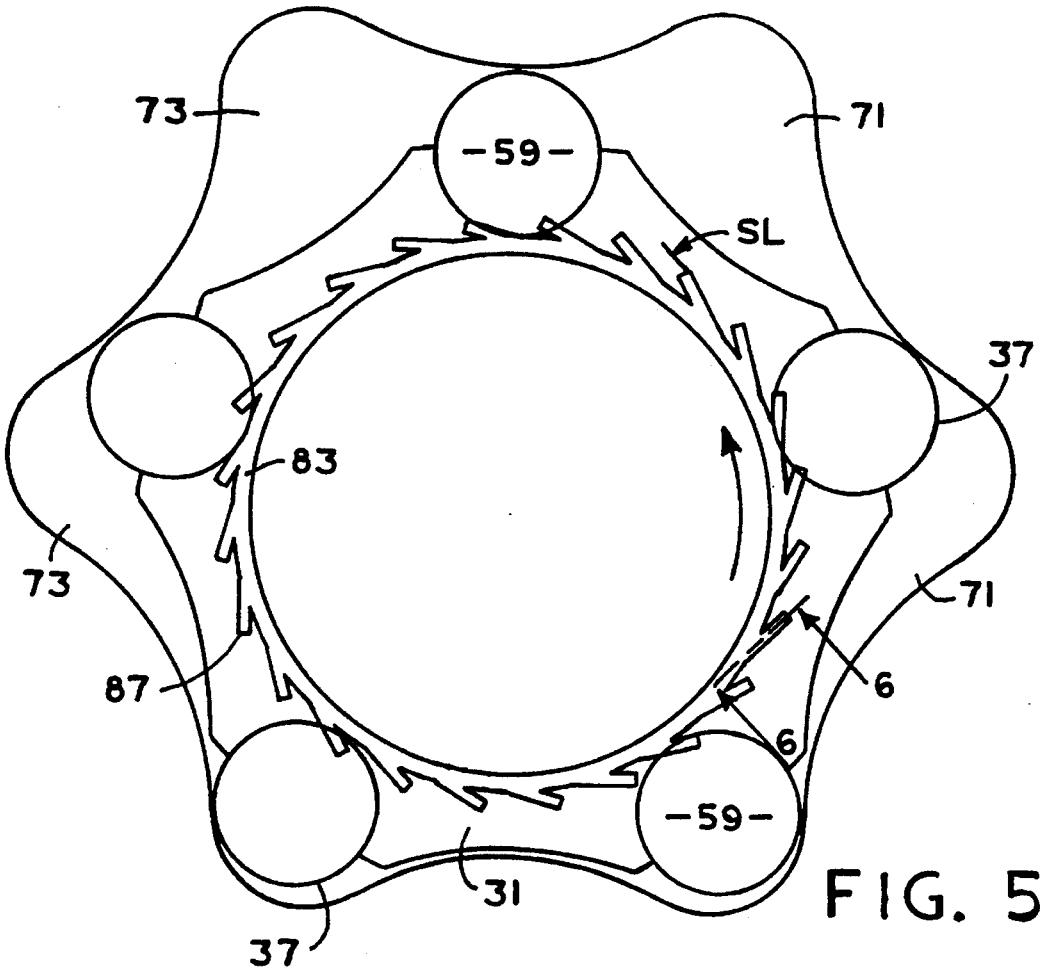
FIG. 5 is a somewhat schematic, overlay view, similar to FIGS. 3 and 4, but on a larger scale, illustrating the relationship of the gerotor shown in FIG. 3 and the sealing member shown in FIG. 4.
Figure 6:
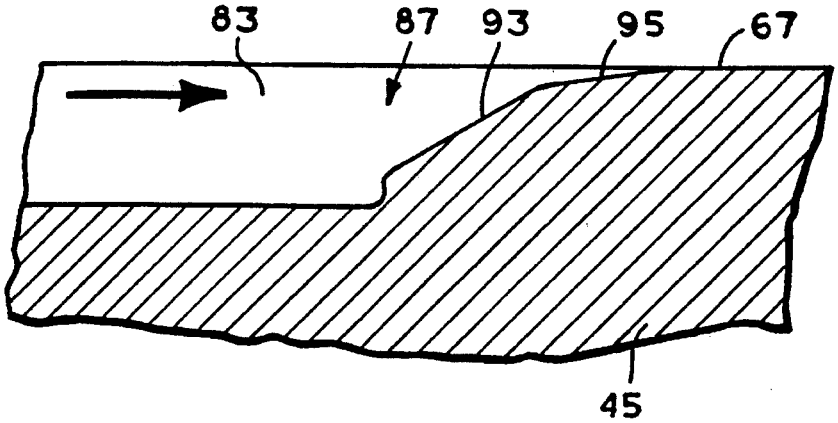
FIG. 6 is a substantially enlarged cross-section, taken on line 6—6 of FIG. 5, illustrating the configuration of one of the grooves of the present invention.

Referring now primarily to FIGS. 5 and 6, the preferred location of the various passages and grooves 83–91, relative to the inner rotor 31 and the roller members 37 will be described. In selecting the location of the annular passage 83 and the fluid grooves 87, there are two competing considerations. On the one hand, it is desirable for the fluid grooves 87 to extend as far out radially as possible, to maximize the extent to which the end surface 59 of the roller member 37 is subjected to the fluid pressure in the fluid grooves 87. On the other hand, no portion of the fluid grooves 87 (or of the annular passage 83) can extend radially outward beyond the "valley" of the inner rotor 31. As used herein, the term "valley" refers to the part of the inner rotor profile, disposed between adjacent rollers 37, where the radius of the rotor is a minimum. In other words, between the radially outermost extent of the fluid groove 87, and the minimum radius or valley of the inner rotor 31, there must still be enough of a sealing land, designated SL in FIG. 5, such that high pressure fluid in the fluid grooves 87 does not leak into the low pressure fluid in the expanding volume chambers 71.

In regard to the number of the fluid grooves 87, it is preferable that, throughout the rotation of the inner and outer rotors, the end surface 59 of each of the rollers 37 always (continuously) has at least a portion of one of the fluid grooves 87 disposed axially adjacent thereto.

Referring again primarily to FIG. 4, the location of the arcuate fluid passages 89 and fluid grooves 90 and 91 is somewhat less critical than that of the passage 83 and grooves 87. It is essential merely that the arcuate passages 89 are disposed far enough outward radially such that there not be any fluid leakage from the passage 89 into the low pressure in the expanding volume chambers 71. Similarly, the fluid grooves should extend far enough radially outwardly to provide the desired result (to be described subsequently) but there should still be a substantial sealing land between the radially outer extent of each of the grooves 91 and the OD of the bushing block 45.

Referring now primarily to FIG. 6, the configuration of the fluid grooves, and the operation of the present invention will be described. Each fluid groove 87 is preferably completely open to the annular fluid passage 83, and adjacent thereto, defines a connecting bottom surface 93 in the relatively deeper portion of the groove 87. In the subject embodiment, the groove 87 also includes a terminal portion (i.e., the portion of the groove 87 which is the furthest from the passage 83), which is defined by an angled bottom surface 95. Although not an essential feature of the present invention, the surface 93 is somewhat steeper than the surface 95.

With the rotors rotating counter-clockwise in FIG. 5, the end surface 59 of each roller 37 passes over each fluid groove 87, dragging a portion of the fluid from the annular passage 83 in the direction shown by the arrow in FIG. 6. As the roller end surface drags the fluid into the groove 87, and up the angled surface 93, then up the shallower surface 95, the fluid pressure in the groove 87 builds, reaching a peak pressure (perhaps substantially greater than the pump outlet pressure) just as the roller end surface 59 passes just beyond the point where the angled surface 95 ends at the end surface 67. The building pressure biases the roller member 37 axially away from the end surface 67 of the forward bushing block 45, just enough to prevent gouging or galling, and, if properly designed, will maintain sufficient fluid under the end surface 59 of the roller to maintain lubrication between the end surface 59 and the wear surface 67, until the roller member repeats the cycle by passing over the next successive fluid groove 87.

Those skilled in the art will understand that the present invention is not limited to the configuration of the fluid grooves 87 shown in FIG. 6. For example, the fluid groove 87 could comprise a single, angled bottom surface (rather than the two surfaces 93 and 95), or could comprise a stepwise arrangement. Thus, the specific configuration of the bottom surface of the groove 87 is not essential, but what is essential is that the fluid groove become progressively shallower in the direction of rotation so that the fluid being dragged by the roller end surface 59 is squeezed and fluid pressure builds in the groove. Those skilled in the art will also understand that if the pressure reaches a peak at or just beyond the junction of the angled surface 95 and the end surface 67, there will then be a downward pressure "gradient", i.e., the fluid pressure between the end surface 67 and the roller end surface 59 will gradually decrease as the roller moves further away from the end of the fluid groove 87. As noted previously, it is preferable that the roller be in communication with the next fluid groove 87 before the gradient from the previous fluid groove 87 reaches a substantially lower pressure.

It is another important feature of the present invention that the arrangement illustrated and described is somewhat "self-compensating". In other words, as the pressure rises in the fluid outlet port 21, the bushing blocks 45 and 47 are biased toward the rotors 31 and 39 with greater force, further reducing the "clearance" between the end surfaces of the rotors and the bushing blocks. As the bushing blocks are squeezed tighter against the ends of the rotors, thus increasing the likelihood of galling and gouging, the fluid pressure in the grooves 87 and 91 rises, thus automatically offsetting or compensating for the greater clamping force being applied to the bushing blocks 45 and 47.

It should be understood by those skilled in the art, that the above explanation of the operation of the fluid grooves 87 also applies equally to the fluid grooves 91, with the only difference being the nature of the surface passing over the arcuate passages 89 and the fluid grooves 91. In other words, as the forward end surface 63 and the rearward end surface 65 pass over the passages 89 and the grooves 90 and 91, and as the forward end surface 55 and the rearward end surface 57 pass over the passage 83 and the grooves 87, there is no likelihood of gouging, as in the case of the end surfaces 59 and 61 of the rollers 37. However, especially in the case of the end surfaces 55 and 57 of the inner rotor 31, there is the possibility of cocking or tilting, which can result in edge loading against the adjacent wear surfaces 67 and 69.

Alternative Embodiments

Referring now primarily to FIGS. 7 and 8, there is illustrated an alternative embodiment of the present invention. In the primary embodiment, all of the fluid grooves 87, 90 and 91 were oriented on only one direction, and thus, would perform the desired function for only one direction of rotation of the rotors 31 and 39. Such an arrangement is acceptable, for example, in the case of a pump which is designed to have its input rotate only clockwise, or only counter-clockwise. However, in the case of a motor, it is desirable for the device to be able to operate in a bi-directional manner.

In the alternative embodiment of FIGS. 7 and 8, in which like elements bear like numerals, new or modified elements bear reference numerals in excess of 100. Therefore, the bushing block 45 again defines a generally annular fluid passage 83. Extending radially outward from the passage 83 is a plurality of radial fluid grooves 101, each of which opens into a circumferential fluid groove 103. Each fluid groove 103 defines an angled bottom surface 105 and a terminal portion 107 in the counter-clockwise direction of rotation, and defines an angled bottom surface 109 and a terminal portion 111 in the clockwise direction of rotation.

Therefore, with the rotors rotating in the counter-clockwise direction in FIG. 7 (and each roller 37 moving to the right relative to FIG. 8), the end surface 59 of each roller drags the fluid up the surface 105 and through the terminal portion 107, in the same manner as described previously. With the rotors rotating in the clockwise direction (and with each roller moving to the left in FIG. 8), the end surface 59 of each roller drags fluid up the surface 109 and through the terminal portion 111, thus providing pressurized fluid on the end of the roller, for either direction of rotation of the rotors.

In the case of the "bi-directional" embodiments of the invention, the angle of the surfaces 105 through 111 is more important than is the angle of the surfaces 93 and 95 in the "uni-directional" embodiment. The angles should be selected such that the rate of pressure rise, as the roller drags fluid up the surface, is acceptable. At the same time, however, the angle on the "diverging" side should not be so shallow that the movement of the roller results in fluid starvation, which can lead to cavitation.

Referring now primarily to FIGS. 9 and 10, there is illustrated another alternative embodiment of the present invention, in which like elements bear like numerals, and new or modified elements bear reference numerals in excess of 120. in the embodiment of FIGS. 9 and 10, the bushing block 45 again defines the generally annular fluid passage 83, but in open communication therewith is another generally annular fluid passage, generally designated 121. Unlike the passage 83, the passage 121 does not have a generally constant depth. Instead, the passage 121 may include a flat bottom portion 123, the circumferential extent of which is not critical. Adjacent the portion 123 is an angled bottom surface 125 and a terminal portion 127. As the rollers 37 move in a counter-clockwise direction as viewed in FIG. 9 (to the right as viewed in FIG. 10), fluid is dragged up the surface 125 and through the terminal portion 127, in the same manner as described in connection with the previous embodiment. On the circumferentially opposite side of the bottom portion 123 is an angled bottom surface 129 and a terminal portion 131. As the rollers rotate clockwise as viewed in FIG. 9 (to the left as viewed in FIG. 10), the roller end surfaces 59 drag fluid up the surface 129 and through the terminal portion 131, in the same manner as described in the previous embodiment.

For ease of illustration, the structure just described is shown in FIGS. 9 and 10 as being immediately repetitive, i.e., each terminal portion 127 meets an adjacent terminal portion 131 at a short flat (where the fluid pressure on the roller end surface 59 would be greatest). It should be understood by those skilled in the art that, instead of the portions 127 and 131 merely forming a short flat as shown, they may be interconnected by a somewhat longer flat. The design and optimization of such details are believed to be within the ability of those skilled in the art.

In the embodiment of FIGS. 9 and 10, there are "fluid grooves" and "terminal portions", just as in the previous embodiments, but the fluid grooves and terminal portions comprise the various surfaces and portions 123 through 131, rather than extending radially from an annular fluid passage, as in the previous embodiments.

One advantage perceived for the embodiment of FIGS. 9 and 10 is the ability to move the annular fluid passage 121 further outward radially than is the passage 83, in view of the fact that there are no grooves extending radially outward from the passage 121. Instead, all required squeezing of fluid and pressure buildup occurs within the annular passage 121, rather than being done in separate fluid grooves 87 and 103.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid displacement mechanism of the type comprising housing means defining a fluid inlet port and a fluid outlet port; a gear set operably associated with said housing means and including a first rotor and a second rotor, each of said first and second rotors defining teeth whereby rotation of said rotors defines an expanding volume chamber in fluid communication with said fluid inlet port and a contracting volume chamber in fluid communication with said fluid outlet port; said housing means defining a first wear surface disposed axially adjacent a first axial end surface of said first and second rotors, and in sealing engagement therewith; characterized by:

(a) said first wear surface cooperating with one of said first and second rotors to define a first generally annular fluid passage in fluid communication with one of said fluid inlet port and said fluid outlet port;

(b) said first wear surface further defining a first plurality of fluid grooves, each of said fluid grooves being in fluid communication with said first annular fluid passage at least a terminal portion of each of said fluid grooves being disposed to be adjacent said first axial end surface of one of said first and second rotors, as said rotors rotate;

(c) each of said terminal portions of said fluid grooves becoming progressively shallower in the direction of rotation of said one of said rotors; and (d) said first fluid passage, said first plurality of fluid grooves, and said terminal portions thereof, being disposed adjacent said first axial end surface of said first and second rotors, and blocked thereby from direct fluid communication with said expanding and contracting volume chambers.

2. A rotary fluid displacement mechanism as claimed in claim 1, characterized by each of said fluid grooves extending radially from said first annular fluid passage.

3. A rotary fluid displacement mechanism as claimed in claim 1, characterized by said housing means defining a second wear surface disposed axially adjacent a second axial end surface of said first and second rotors, and in sealing engagement therewith, said second wear surface cooperating with one of said first and second rotors to define a second generally annular fluid passage in fluid communication with one of said fluid inlet port and said fluid outlet port.

4. A rotary fluid displacement mechanism as claimed in claim 3, characterized by said second wear surface further defining a second plurality of fluid grooves, each of said fluid grooves being in fluid communication with said second annular fluid passage, and extending radially therefrom, at least a terminal portion of each of said fluid grooves being disposed to be adjacent said second axial end surface of said first and second rotors, as said rotors rotate, each of said terminal portions of said fluid grooves becoming progressively shallower in the direction of rotation of said one of said rotors.

5. A rotary fluid displacement mechanism of the type comprising housing means defining a fluid inlet port and a fluid outlet port; a gear set operably associated with said housing means and including an outer rotor and an inner rotor disposed within said outer rotor, one of said rotors including a plurality of teeth, whereby rotation of said inner and outer rotors defines an expanding volume chamber in fluid communication with said fluid inlet port and a contracting volume chamber in fluid communication with said fluid outlet port; said housing means defining a first wear surface disposed axially adjacent first axial end surfaces of said inner and outer rotors, respectively, and in sealing engagement therewith; characterized by:

(a) said first wear surface cooperating with one of said inner and outer rotors to define a first fluid passage in fluid communication with one of said fluid inlet port and said fluid outlet port;

(b) said first wear surface further defining a first plurality of fluid grooves, each of said fluid grooves being in fluid communication with said first fluid passage, and extending radially therefrom, at least a terminal portion of each of said fluid grooves being disposed to be adjacent a first axial end surface of each of said teeth as said rotors rotate; and (c) each of said terminal portions of said fluid grooves becoming progressively shallower in the direction of rotation of said rotors.

6. A rotary fluid displacement mechanism of the type comprising housing means defining a fluid inlet port and a fluid outlet port; a gear set operably associated with said housing means and including an outer rotor and an inner rotor eccentrically disposed within said outer rotor, one of said rotors including a plurality of roller members serving as teeth, whereby rotation of said inner and outer rotors defines an expanding volume chamber in fluid communication with said fluid inlet port and a contracting volume chamber in fluid communication with said fluid outlet port; said housing means defining a first wear surface disposed axially adjacent first axial end surfaces of said inner and outer rotors, respectively, and in sealing engagement therewith; characterized by:

(a) said first wear surface cooperating with one of said inner and outer rotors to define a first generally annular fluid passage in fluid communication with one of said fluid inlet port and said fluid outlet port;

(b) said first wear surface further defining a first plurality of fluid grooves, each of said fluid grooves being in fluid communication with said first annular fluid passage, and extending radially therefrom, at least a terminal portion of each of said fluid grooves being disposed to be adjacent a first axial end surface of each of said roller members as said rotors rotate; and (c) each of said terminal portions of said fluid grooves becoming progressively shallower in the direction of rotation of said rotors.

7. A rotary fluid displacement mechanism as claimed in claim 6, characterized by the number of said first plurality of fluid grooves being selected such that, as said rotors rotate, each roller member continuously has at least a portion of one of said terminal portions disposed adjacent said first axial end surface of said roller member.

8. A rotary fluid displacement mechanism as claimed in claim 6, characterized by said first annular passage, said first plurality of fluid grooves, and said terminal portions thereof being configured and disposed to be adjacent said first axial end surface of said one of said inner and outer rotors and blocked from direct fluid communication with said expanding and contracting volume chambers.

9. A rotary fluid displacement mechanism as claimed in claim 6, characterized by said housing means including a main housing member and a sealing member operable to move axially relative to said main housing member, said sealing member defining said first wear surface, a portion of said sealing member being in open fluid communication with whichever of said fluid inlet port and said fluid outlet port contains relatively higher pressure, whereby said sealing member is biased axially toward engagement with said first axial end surfaces of said inner and outer rotors, respectively.

10. A rotary fluid displacement mechanism as claimed in claim 6, characterized by said inner rotor includes said plurality of roller members, said first generally annular fluid passage being disposed radially inward from an imaginary circle defined by the axis of rotation of said roller members.

11. A rotary fluid displacement mechanism as claimed in claim 10, characterized by said first wear surface cooperating with said outer rotor to define a second generally annular fluid passage in fluid communication with one of said fluid inlet port and said fluid outlet port, and said first wear surface further defining a second plurality of fluid grooves, each of said fluid grooves being in fluid communication with said second annular fluid passage, and extending radially therefrom, at least a terminal portion of each of said fluid grooves becoming progressively shallower in the direction of rotation of said rotors.

12. A rotary fluid displacement mechanism as claimed in claim 6, characterized by said housing means defining a second wear surface disposed axially adjacent second axial end surfaces of said inner and outer rotors, respectively, and in sealing engagement therewith, said second wear surface cooperating with one of said inner and outer rotors to define a second generally annular fluid passage in fluid communication with one of said fluid inlet port and said fluid outlet port.

13. A rotary fluid displacement mechanism as claimed in claim 12, characterized by said second wear surface further defining a second plurality of fluid grooves, each of said fluid grooves being in fluid communication with said second annular fluid passage, and extending radially therefrom, at least a terminal portion of each of said fluid grooves being disposed to be adjacent a second axial end surface of each of said roller members as said rotors rotate; and each of said terminal portions of said fluid grooves being progressively shallower in the direction of rotation of said rotors.

* * * * *